US008657149B2

(12) United States Patent
Roesler

(10) Patent No.: US 8,657,149 B2
(45) Date of Patent: Feb. 25, 2014

(54) THIN-WALLED PACKAGING SHEATH CLOSURE HAVING A FORM-SHAPING SUPPORT PART

(76) Inventor: Peter Roesler, Wangen/Allgau (DE)

( * ) Notice: Subject to any disclaimer, the term of this patent is extended or adjusted under 35 U.S.C. 154(b) by 663 days.

(21) Appl. No.: 12/697,722

(22) Filed: Feb. 1, 2010

(65) Prior Publication Data

US 2010/0193533 A1 Aug. 5, 2010

(30) Foreign Application Priority Data

Jan. 30, 2009 (DE) ..... 10 2009 006 824

(51) Int. Cl.
*B65D 41/16* (2006.01)
*B65D 41/18* (2006.01)

(52) U.S. Cl.
USPC ..... 220/780; 220/787; 220/802; 220/751; 220/200; 220/DIG. 19; 215/45; 215/321; 215/322

(58) Field of Classification Search
USPC ..... 220/751, 752, 780, 784, 787, 789, 790, 220/791, 792, 793, 4.21, 214, 802, 805, 220/212.5, 736, 200, DIG. 19; 215/250, 215/398, 399, 396, 395, 45, 321, 344, 215/DIG. 1, 354, 355, 322; 206/38, 234, 206/806, 443, 214, 528; 222/153.05, 222/153.06; 40/310, 321, 313, 311
See application file for complete search history.

(56) References Cited

U.S. PATENT DOCUMENTS 2,721,595 A * 10/1955 Nichols ..... 220/800
3,335,923 A * 8/1967 Healy ..... 222/542
3,446,391 A * 5/1969 Yates, Jr. ..... 220/792

FOREIGN PATENT DOCUMENTS

JP 04339770 A * 11/1992

* cited by examiner

*Primary Examiner* — J. Gregory Pickett
*Assistant Examiner* — Blaine Neway
(74) *Attorney, Agent, or Firm* — Cohen & Grigsby, P.C.

(57) ABSTRACT

A resealable, thin-walled packaging having snap-in closure wherein the packaging sheath has an, open plug-in collar that receives a snap-in closure with a form-shaping support part that extends into the collar.

17 Claims, 6 Drawing Sheets

THIN-WALLED PACKAGING SHEATH CLOSURE HAVING A FORM-SHAPING SUPPORT PART

PRIORITY CLAIM

Figure 2:
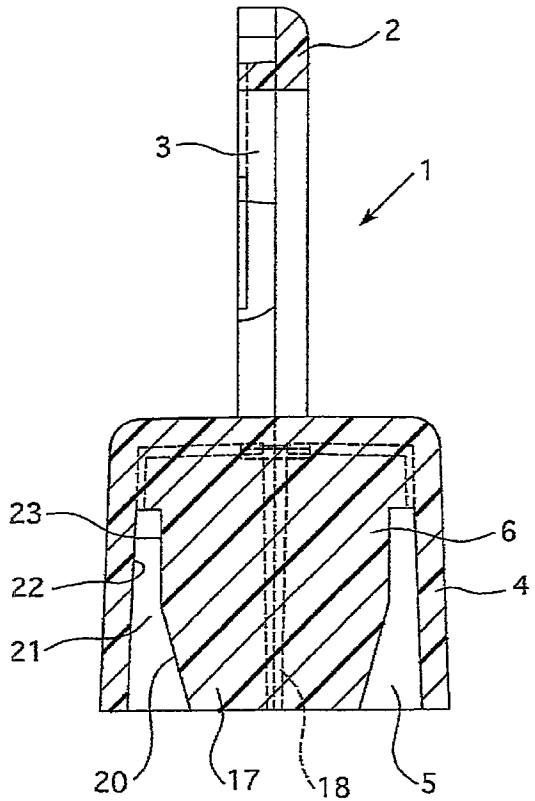

This application claims priority to German Patent Application No. 102009006824.4 filed on Jan. 30, 2009.

The invention relates to a closing part for a thin-walled packaging sheath that is suited for repeated use. The thin-walled packaging sheath is provided with a snap-in part as a closure whereby the packaging sheath and the closure make a re-sealable packaging device.

Sheath-shaped, thin-walled packaging devices are used for packaging the most varied objects, such as for example, pins or pencils, drills, saw blades, and oblong objects of all types. With this type of thin-walled packaging devices, there is the need for minimizing the wall thickness of the sheath-shaped, thin-walled packaging device more and more in order, for example, to achieve a wall thickness of less than 0.5 mm. This is desirable on the one hand, for reasons of material savings and on the other hand, for reasons of cost savings. However, the disadvantage of this type of thin-walled packaging devices lies in the fact that such a thin-walled packaging device also has to be closed with a corresponding closing part and that the thin-walled packaging device then has to be so unstable that the walls thereof do not bulge out. This is true in particular when a correspondingly important packaging object is inserted in the sheath-shaped packaging device. This means that there is a contradiction between the wall thickness of the packaging device having to be as thin as possible and the weight-bearing stability and shape stability thereof.

Here, differentiation has to be made from a so-called blister packaging device which is only suitable as disposable device and is opened and thrown out after a single use.

The present invention thus has in common with the prior art reference a thin-walled packaging device suitable for repeated usage and being equipped with a suitable closing part wherewith the packaging device, which is open on at least one side, can be resealably closed.

Up to now only the use of relatively thick-walled packaging devices with a wall thickness of more than 0.5 mm has been known to the art as well as the construction of the closing part only as snap-in part having simply a plug-in space into which the upper open plug-in collar of the packaging device is plugged.

This however entails the disadvantage that when using a thin-walled packaging device, this packaging device can no longer be securely plugged into the closing part and is not strongly held in the closing part because as a rule, it is impossible to punch holes into the thin-walled material wherewith the closing part can enter into holding engagement.

The object of the invention therefore is the further development of a closing part for a sheath-shaped, thin-walled packaging device of the type mentioned above in such a way that even for thin-walled devices deforming themselves self-acting under the impact of stress, a secure snap-in attachment between the closing part and the thin-walled packaging device is always established.

In order to achieve the object of the invention, the invention includes a packaging sheath that has an upper, open plug-in collar that defines a plug-in area. The closing part has a form-shaping support part that penetrates into the plug-in area and that can be snapped in place. The support part is made of harder material than the material of the packaging sheath.

An essential feature of the invention is the fact that at least one form-shaping support part is disposed in the plug-in area (interior) of the closing part, at the location of the packaging sheath to be plugged in, said support part penetrating into the plug-in collar of the packaging sheath thereby stabilizing and shaping the said plug-in collar and holding the same in this form-shaping position in snap-in position within the closing part.

Based on the given enabling disclosure, the advantage now arises for the first time that unstable, thin-walled packaging devices can be manufactured as packaging sheath; and that the closing part in.

In this way, the essential advantage is obtained that an absolutely even surface transition from the surface of the packaging sheath to the adjoining wall surface is established, which is particularly important for gluing on labels.

Labels of this type thus are glued over both parts (closing part and packaging sheath), and the continuous and fluid transition between the two walls ensures that the label can be glued in particularly esthetically flawless manner flush over both surfaces without incurring surface rebounds, dents, or protrusions on the two surfaces.

Labels of this type are used in order to prevent the closing part from being undesirably pulled off the packaging sheath. This is therefore, a tamper-indicating closure the integrity whereof is to be clearly visible from the outside. For this reason, it is of great importance to achieve a flush surface transition between the casing surface of the closing part and the corresponding wall of the packaging sheath. This is achieved flawlessly with the closing part according to the invention and the support part disposed in the interior.

A particular development of the invention provides for the support part to be injection-molded onto the closing part as a single piece of material.

A further development provides for the support part to comprise a number of transverse ribs form-shapingly connected to one another by at least one longitudinal rib.

In this context it is of importance that the longitudinal and the transverse ribs form a lower, relatively wide insertion space where initially, the upper, circumferential plug-in collar of the packaging sheath is plugged in. In order now to achieve the desired form-shaping of the plug-in collar, the support part with its longitudinal and transverse ribs is equipped with form-shaping, radially outward-expanding guide-in gradients ending finally in a narrow upper insertion space wherein the upper rim of the plug-in collar of the packaging sheath is form-shapingly inserted.

In this way, said plug-in collar of the packaging sheath is on the one hand form-shapingly supported by the support part on the internal side, and on the other hand, is form-shapingly held against the internal wall of the circumferential casing surface of the closing part.

With the mentioned disposition of a support part therefore, the advantage is obtained that the plug-in collar of the packaging sheath is now flawlessly inserted form-shapingly in the closing part and cannot be unintentionally deformed.

A particular advantage in this context is obtained when a snap-in connection between the plug-in collar of the packaging sheath and the closing part is provided.

A snap-in connection of this type may be formed by a radially inward-pointing snap-in rib disposed on the closing part in a manner per se known to the art and functioning in conjunction with a corresponding rebounding snap-in groove in the packaging sheath.

Said snap-in connection as well is characterized by corresponding suitable guide-in gradients in order to make a flawless snap-in connection possible.

In kinematic reversal of the said snap-in connection, it is naturally also provided to have the plug-in collar of the packaging sheath constructed as protruding snap-in rib and, in juxtaposition, to dispose a rebounding snap-in groove in the wall of the support part.

The embodiments described below all refer to a packaging sheath of approximately rectangular cross section functioning in conjunction with a closing part also shaped with an approximately rectangular cross section.

However, the invention is not limited to this. It is also possible to provide for the packaging sheath to be constructed with a circular, oval, polygonal, or square cross section and then for the closing part to be respectively adapted to this shape.

With all embodiments it is only of importance that a form-shaping support part is disposed in the interior of the closing part, said support part engaging with the upwardly-open plug-in collar of the packaging sheath in a way to form-shapingly stabilize the said plug-in collar in the closing part and to establish the snap-in connection therewith.

A packaging sheath of this type may consist of the following synthetic materials: PE: polysterol, PVC, and other similar materials.

It is particularly preferred to have the packaging sheath manufactured in an injection blow molding procedure, because particularly thin wall thicknesses are hereby achievable though the same are highly load-transmitting; and any deformation occurring with the insertion of a packaging load is now prevented according to the invention due to the support part disposed in the closing part.

The subject matter of the present invention does not only derive from the subject matter of the individual patent claims, but also from the combination of the individual patent claims among one another.

All data and features disclosed in the documentation, including the abstract, and in particular, the spatial structure represented in the drawings are claimed as essential for the invention in so far as they are novel individually or in combination in relation to the prior art.

Below, the invention is explained in more detail with reference to drawings representing several embodiments. Further features and advantages essential for the invention ensue from the drawings and the description thereof.

Figure 1:
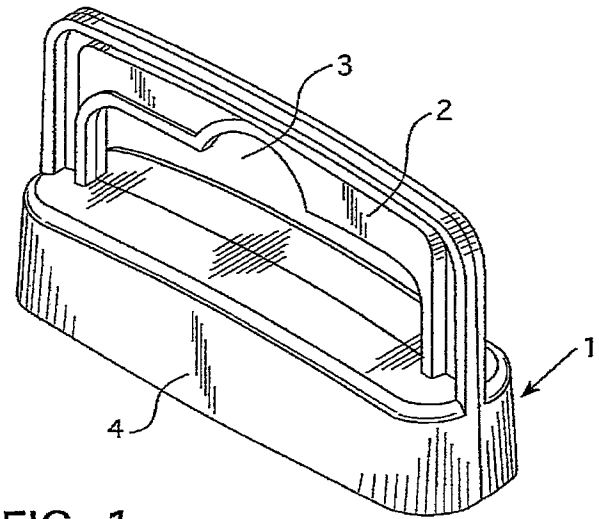
Figure 5:
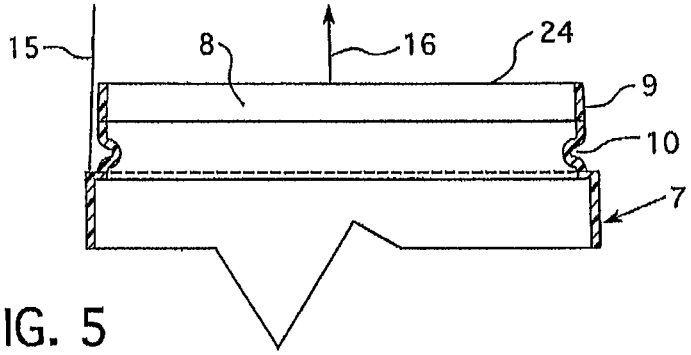
Figure 6:
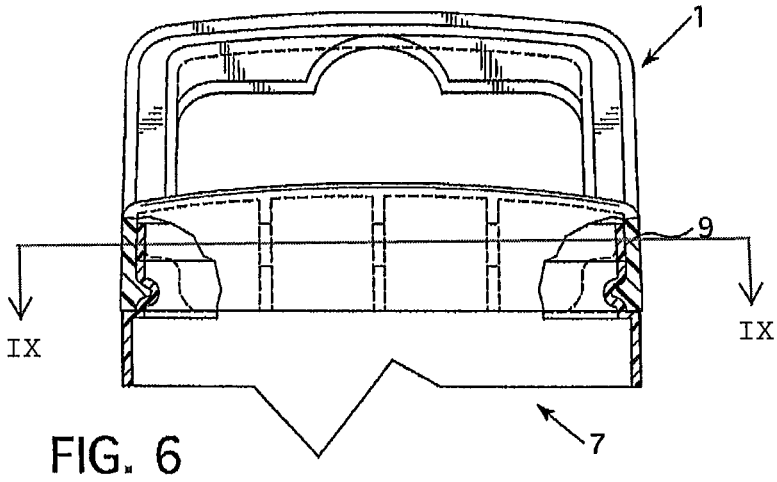
Figure 7:
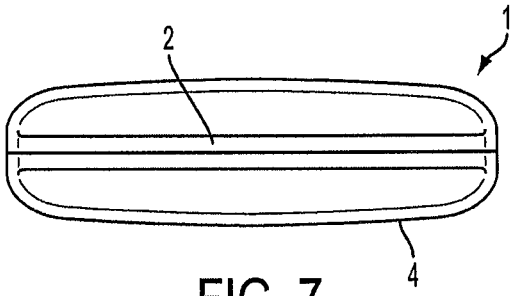
Figure 8:
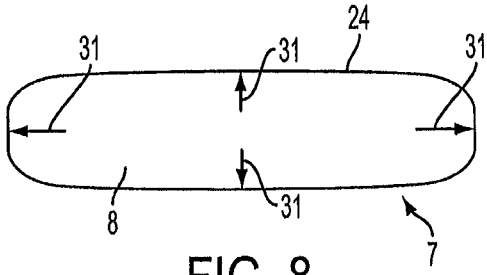
Figure 9:
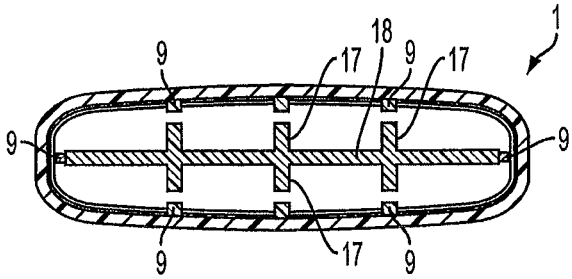
Figure 10:
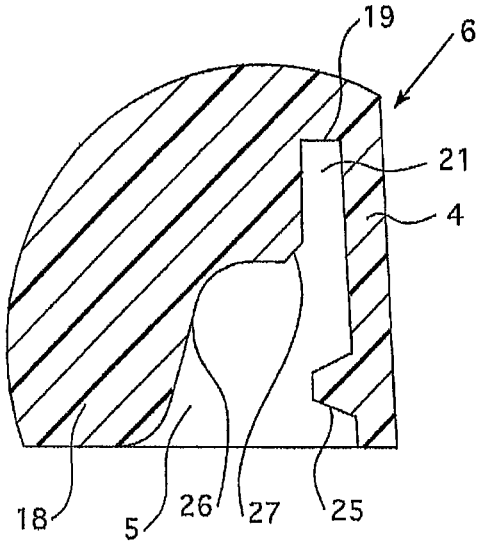
Figure 11:
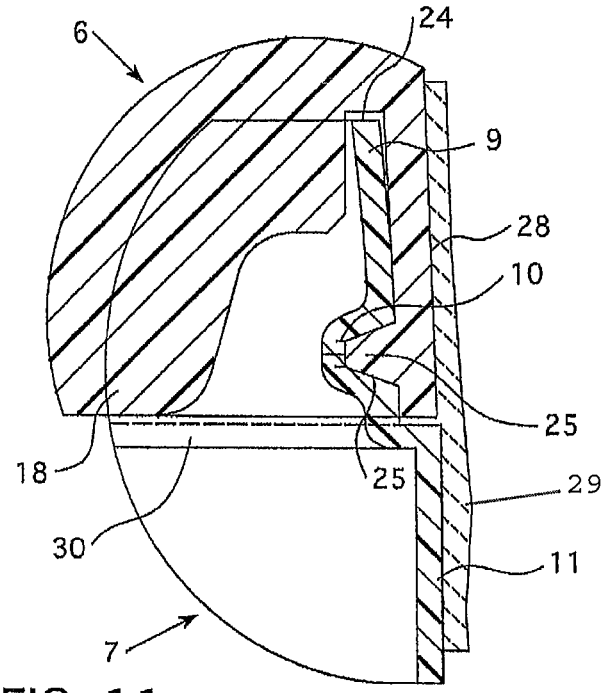

The drawings show in:

FIG. 1: perspective view of a closing part according to the invention;

FIG. 2: central cross section through the closing part according to FIG. 1 at the level of a transverse rib;

3: perspective view of a packaging sheath functioning in conjunction with the closing part;

4: schematic view of a section through the closing part;

FIG. 5: an enlarged section through the upper part of the packaging sheath;

FIG. 6: a section through the packaging sheath inserted in the closing part;

FIG. 7: top view of the closing part from above;

FIG. 8: top view of the plug-in collar of the packaging sheath;

FIG. 9: a sectional view of the arrangement of the connection between the closing part and the plug-in collar of the packaging sheath taken along lines IX-IX of FIG. 6;

FIG. 10: an enlarged sectional view through a longitudinal rib of the support part in the closing part;

FIG. 11: the assembly drawing of the snap-in engagement between the closing part and the packaging sheath.

Figure 12:
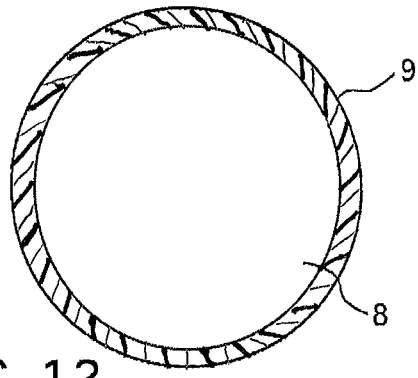
Figure 13:
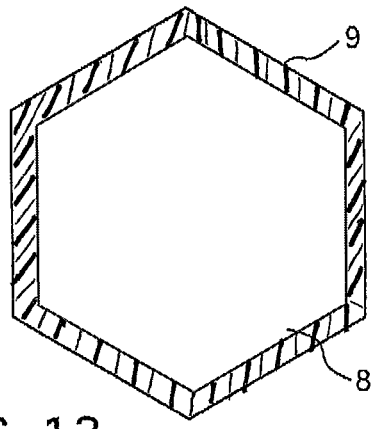
Figure 14:
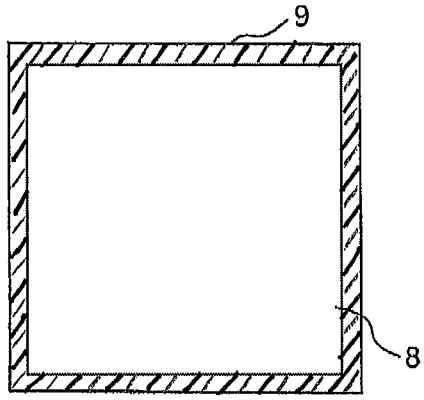

FIG. 12: top view of a circular embodiment of the plug-in collar of the packaging sheath;

FIG. 13: top view of a polygonal embodiment of the plug-in collar of the packaging sheath;

FIG. 14: top view of a square embodiment of the plug-in collar of the packaging sheath.

FIG. 1 generally shows a closing part 1 comprising a circumferential casing surface 4 having a lower insertion opening 5 for the plug-in insertion of a plug-in collar 9 of a packaging sheath 7. A display holder 2 here is formed onto the upper end of the closing part 1 and contains a suspension hole 3 as known per se to the art.

Now it is important in accordance with FIG. 2 that a support part 6 is disposed in the interior of the insertion opening 5 of the closing part 1, said support part 6 comprising a number of transverse ribs 17 and at least one longitudinal rib 18 longitudinally connecting the transverse ribs 17, wherein the mentioned transverse and longitudinal ribs 17, 18 extend from the insertion opening 5 inward at a slant and form, according to FIG. 2, a first guide-in gradient 20 for the plug-in collar 9 (see FIG. 3) of the packaging sheath 7. The said guide-in gradient 20 transitions into a narrower form-shaping insertion space 21, said insertion space 21 being on one side limited by the internal wall 22 of the closing part 1 and on the other side, by a guide edge 23 in the area of one transverse rib 17 each.

Figure 3:
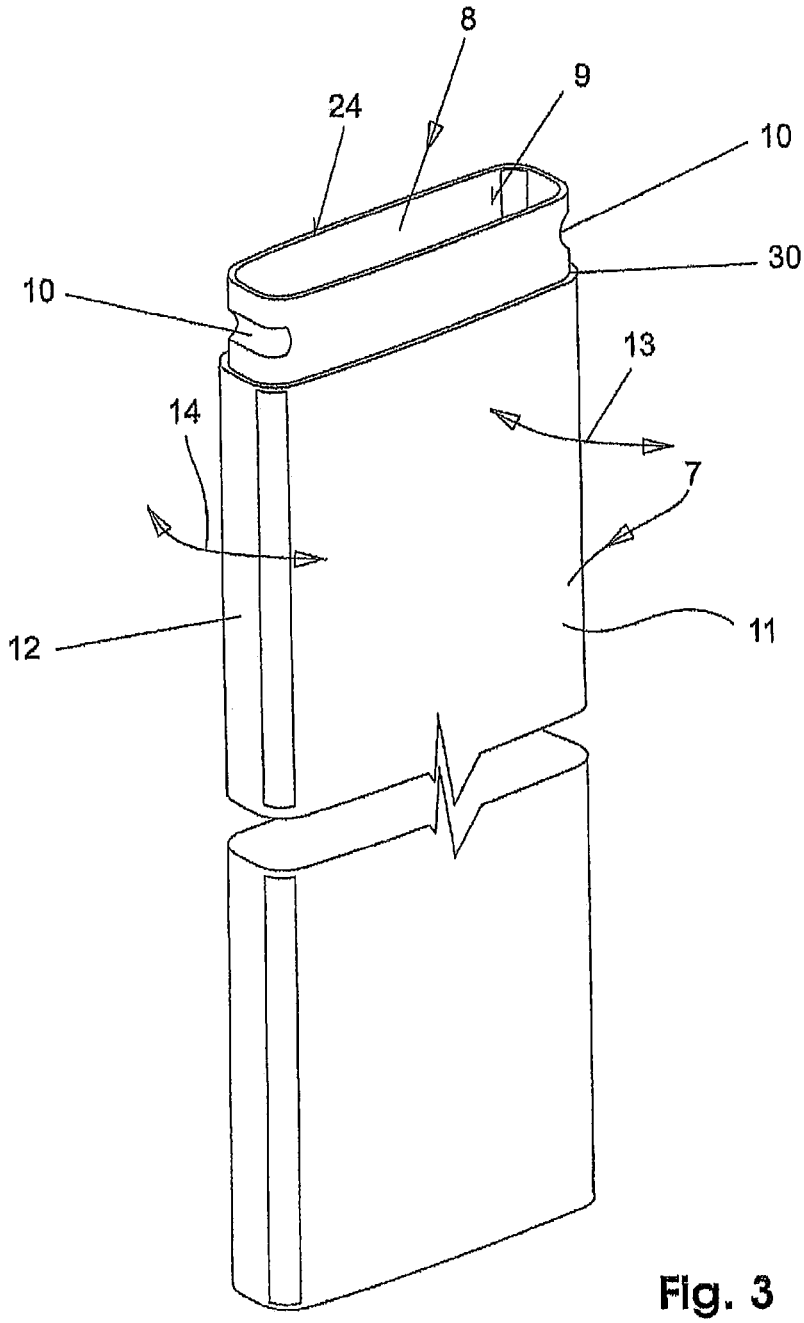

FIG. 3 shows that the packaging sheath 7 has an upper opening 8 defined by the circumferential plug-in collar 9.

Inward-pointing snap-in grooves 10 disposed opposite one another are located on the frontal sides of the plug-in collar 9.

In the general description part already the fact was pointed out that the said snap-in grooves may also be replaced by snap-in ribs.

Equally it may be provided to have the said snap-in grooves 10 or snap-in ribs also disposed on the longitudinal sides of the plug-in collar 9.

It is of importance that the wall 11 of the packaging sheath 7 is of such low thickness that the risk arises for the wall 11 to bulge out and, for example, to be deformed in direction of the arrows 13 while on the other hand, the frontal walls 12 of the packaging sheath 7 may also be deformed in the direction of the arrows 14.

In order to prevent this, it is provided to have the support part 6 of the closing part 1 according to the invention penetrate into the upper opening 8 of the plug-in collar 9 and form- shapingly stabilize the plug-in collar 9.

Based on the said stabilization of the plug-in collar 9, the walls 11, 12 of the packaging sheath 7 adjoining over a stiffening edge 30 are also stiffened and form-shapingly joined to the closing part 1.

Figure 4:
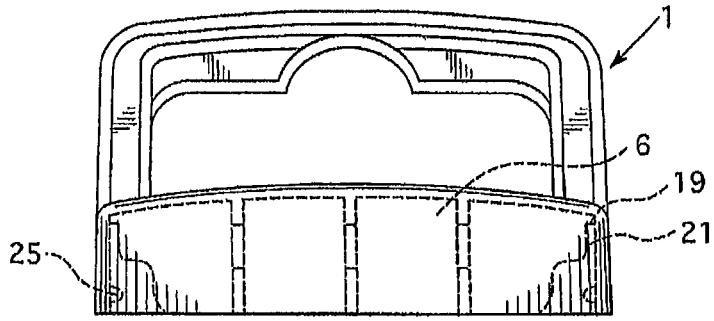

FIG. 4 shows that inward-pointing snap-in ribs 25 are disposed on the closing part 1 in the interior of the casing surface 4, said snap-in ribs 25 functioning in conjunction with the above mentioned snap-in grooves 10 (see FIG. 5) of the packaging sheath 7.

FIGS. 4 and 5 show that therefore, the packaging sheath 7 is guided in the direction of the arrow 16 against the closing part 1, thereby causing the support part 6 comprising the transverse ribs 17 and the longitudinal rib 18 to then penetrate into the interior of the packaging sheath 7 and to stiffen the plug-in collar 9.

In this context, it is preferred to have the plug-in collar 9 slightly tilted inward in order to thereby form a guide-in gradient 15 for the guide-in into the insertion opening 5 of the closing part 1.

The upper frontal side 24 of the plug-in collar 9 then runs along a row of sequentially disposed guide-in gradients as can best be seen in FIGS. 10 and 11. FIG. 10 here shows a section through a longitudinal rib 18, and it can be noticed that the latter forms a guide-in gradient 26 transitioning into an additional, slantedly subsequent guide-in gradient 27 and that then both guide-in gradients 26, 27 finally lead into the narrower form-shaping insertion space 21 which is limited upward by a stop 19.

As can be noticed in FIG. 11, the upper, circumferential frontal side 24 of the packaging sheath 7 then reaches into the narrow insertion space 21 between the support part 6 and the internal wall of the casing surface 4 and is form-shapingly held there.

FIG. 8 shows that based on the support part 6 penetrating into the opening 8 of the packaging sheath 7, an edge stress is generated in the direction of arrows 31 so that the unstable walls of the plug-in collar 9 of the packaging sheath 7 are pre-stressed outward. FIGS. 6, 7, and 9 here show that the longitudinal ribs 18 and the transverse ribs 17 generate the said edge stress onto the unstable plug-in collar 9 of the packaging sheath 7.in the direction of the arrows 31. Based on the stable snap-in position of the packaging sheath 7 in the closing part 1 according to FIG. 11, it can be noticed that here a smooth surface 28 continues on the external wall of the closing part 1 to the wall 11 of the packaging sheath 7 progressively and continuously so that these two continuously adjoining surfaces 28, 11 are free from rebound, are relatively jointless, and therefore allow easy gluing of a label 29 over the same, whereby a tamper- indicating closure is generated.

Once the said walls 11, 28 transition jointlessly into one another, the advantage arises that in spite of the unstable wall 11 of the packaging sheath 7, a smooth, crease-free and wrinkle-freed surfae exists and can conveniently have a label 29 glued thereon.

DRAWING LEGEND

1 Closing part
2 Display holder
3 Suspension hole
4 Casing surface
5 Insertion opening
6 Support part
7 Packaging sheath
8 Opening
9 Plug-in collar
10 Snap-in groove (or rib)
11 Wall
12 Frontal wall
13 Direction of arrows
14 Direction of arrows
15 Guide-in gradient
16 Direction of arrows
17 Transverse rib
18 Longitudinal rib
19 Stop
20 Guide-in gradient (17)
21 Insertion space (4, 17)
22 Internal wall (4)
23 Guide edge (17)
24 Frontal side
25 Snap-in rib
26 Guide-in gradient
27 Guide-in gradient
28 Surface (of 1)
29
30 Stiffening rim
31 Direction of arrows (edge stress)

The invention claimed is:

1. A thin-walled packaging device comprising:

a packaging sheath for repeatable use, said packaging sheath having a plug-in collar with a rim that defines an opening in said packaging sheath, and a snap-in closure that is insertable into the opening of said plug-in collar to releasably close the opening of the plug-in collar of said packaging sheath, said snap-in closure having a form-shaping support part that includes at least one longitudinal rib that is connected to a plurality of transverse ribs, said form-shaping support part defining a guide-in gradient surface, said guide-in gradient surface cooperating with an inner wall of said snap-in closure to define an insertion opening that has a terminal end and a lower region that is located oppositely from said terminal end, said guide-in surface expanding outwardly from the lower region of said insertion opening to the terminal end of said insertion opening such that said form-shaping support part contacts the plug-in collar and urges the plug-in collar outwardly toward the inner wall of the snap-in closure at times when said form-shaping support part is inserted into the opening of said plug-in collar and the rim of said plug-in collar is advanced toward the terminal end of said insertion opening, said form-shaping support part being composed of a material that is harder than the material that composes said packaging sheath.

2. The packaging device according to claim 1 wherein said form-shaping support part stabilizes and shapes the plug-in collar of said packaging sheath and holds said plug-in collar in a form-shaping position at times when the guide-in gradient surface of said form-shaping support part of said snap-in closure is urged against the plug-in collar, said plug-in collar defining a snap-in groove and said snap-in closure defining a rib that engages the snap-in groove of said plug-in collar at times when the snap-in closure is inserted into the opening of the plug-in collar.

3. The thin-walled packaging device of claim 2 wherein the snap-in closure defines a first external surface and wherein the packaging sheath defines a second external surface that abuts said first external surface, the first external surface of the snap-in closure being located evenly with the second external surface of the packaging sheath at the location where the snap-in closure abuts the packaging sheath.

4. A thin-walled packaging device according to claim 2 wherein said snap-in closure includes a casing that defines an external surface and wherein said packaging sheath also defines an external surface, the external surface of said casing cooperating with the external surface of said packaging sheath to form an even surface transition between said casing and said packaging sheath to which a label can be glued flush and without surface rebound.

5. A thin-walled packaging device according to claim 4 wherein the label serves as a taper-indicating structure.

6. A thin-walled packaging device according to claim 2 wherein said form-shaping support part is injection-molded with the snap-in closure as a single piece of material.

7. A thin-walled packaging device according to claim 2 wherein at least one longitudinal rib and at least one transverse rib define a form-shaping support part that is received in the opening of said plug-in collar of the packaging sheath at times when the snap-in closure is inserted into the opening of the plug-in collar.

8. A thin-walled packaging device according to claim 2 wherein the form-shaping support part includes longitudinal and traverse ribs that define said form-shaping, guide-in gradient surface and wherein the terminal end of said insertion opening has a radial dimension that is shorter than the radial dimension of the lower region of said terminal end, the rim of said plug-in collar of the packaging sheath being inserted in the terminal end of said insertion opening at times when said snap-in closure is snapped into said plug-in collar.

9. A thin-walled packaging device according to claim 4 wherein said casing further defines an internal surface and wherein the form-shaping support part of said snap-in closure supports the internal side of the plug-in collar of said packaging sheath and the external surface of the plug-in collar is form-shapingly maintained against the internal surface of the casing of the snap-in closure.

10. A thin-walled packaging device according to claim 8 wherein the plug-in collar of the packaging sheath includes a protruding snap-in rib and wherein said snap-in closure includes a wall that has a rebounding snap-in groove that receives the snap-in rib of the plug-in collar at times when the snap-in closure is fully inserted into the plug-in collar.

11. A thin-walled packaging device according to claim 2 wherein the packaging sheath defines a cross-section that is selected from the group comprising a circle, an oval, a polygon, or a square and wherein the shape of the form-shaping support part of the snap-in closure is complementary to the selected shape.

12. A thin-walled packaging device according to claim 2 wherein the packaging sheath is made of one or more of synthetic materials selected from the group comprising: PE or polysterol or PVC.

13. A thin-walled packaging device comprising:

a packaging sheath for repeatable use, said packaging sheath having a plug-in collar that defines an opening in said packaging sheath, and a snap-in closure that is insertable into the opening of said plug-in collar to releasably close the opening of the plug-in collar of said packaging sheath, said snap-in closure having a form-shaping support part that stabilizes and shapes the plug-in collar of said packaging sheath and holds said plug-in collar in a form shaping position, said form-shaping support part including at least a first rib that is connected to a plurality of ribs that are oriented transversely to said first rib, said form-shaping support part extending into the plug-in collar of said packaging sheath and contacting the plug-in collar at times when said form-shaping support part is inserted into the opening of said plug-in collar, said form-shaping support part being composed of a material that is harder than the material that composes said packaging sheath.

14. A thin-walled packaging device according to claim 13 wherein at least one longitudinal rib and at least one transverse rib define a lower form-shaping support part that is received in the opening of said plug-in collar of the packaging sheath at times when the snap-in closure is inserted into the opening of the plug-in collar.

15. A thin-walled packaging device according to claim 14 wherein the snap-in closure defines a terminal insertion space that has an upper region and a lower region with a radial dimension of the upper region being shorter than the radial dimension of the lower region, and wherein the form-shaping support part includes longitudinal and traverse ribs that define a form-shaping, guide-in gradient surface that expands radially outwardly from the lower region to the upper region, said plug-in collar of the packaging sheath having an upper rim that is inserted in the upper region of said terminal insertion space at times when said plug-in collar is snapped into said snap-in closure.

16. A thin-walled packaging device according to claim 15 wherein said snap-in closure defines an internal surface and wherein the form-shaping support part of said snap-in closure supports the internal side of the plug-in collar and the external surface of the plug-in collar is form-shapingly maintained against the internal surface of the snap-in closure.

17. A thin-walled packaging device according to claim 15 wherein the plug-in collar of the packaging sheath includes a protruding snap-in rib and wherein a wall of the snap-in closure includes a rebounding snap-in groove that receives the snap-in rib of the plug-in collar at times when the snap-in closure is fully inserted into the plug-in collar.

* * * * *